US010064525B2

(12) United States Patent
Ader

(10) Patent No.: US 10,064,525 B2
(45) Date of Patent: Sep. 4, 2018

(54) DISPENSER OF TOWELS WETTED WITH HAND SANITIZER

(75) Inventor: Joelle Berdugo Ader, Hampstead (CA)

(73) Assignee: Clean4e LLC

( * ) Notice: Subject to any disclaimer, the term of this patent is extended or adjusted under 35 U.S.C. 154(b) by 0 days.

(21) Appl. No.: 13/810,278

(22) PCT Filed: Jul. 25, 2011

(86) PCT No.: PCT/CA2011/000878

§ 371 (c)(1),
(2), (4) Date: Feb. 1, 2013

(87) PCT Pub. No.: WO2012/009805

PCT Pub. Date: Jan. 26, 2012

(65) Prior Publication Data

US 2013/0126549 A1 May 23, 2013

Related U.S. Application Data

(60) Provisional application No. 61/367,313, filed on Jul. 23, 2010.

(51) Int. Cl.
*A47K 10/42* (2006.01)
*A47K 10/24* (2006.01)
(Continued)

(52) U.S. Cl.
CPC ..... *A47K 10/42* (2013.01); *A47K 7/03* (2013.01); *A47K 10/24* (2013.01); *A47K 2010/328* (2013.01)

(58) Field of Classification Search
CPC ..... A47K 2010/3273; A47K 2010/328; A47K 10/42
(Continued)

(56) References Cited

U.S. PATENT DOCUMENTS 3,942,682 A * 3/1976 McKay ..... 221/58
3,947,134 A * 3/1976 Ogawa ..... 401/118
(Continued)

FOREIGN PATENT DOCUMENTS

CN 201234946 Y 5/2009
CN 201234949 Y 5/2009
(Continued)

OTHER PUBLICATIONS

English abstract of JP 2002306362, Chen, J.
English abstract of CN 201234949, Rongguan, X.
English abstract of CN 201234946, Rongguan, X.

*Primary Examiner* — Patrick H MacKey
(74) *Attorney, Agent, or Firm* — Mark C. Johnson; Johnson |Dalal

(57) ABSTRACT

A device for dispensing towels comprises a container, a sepearet area and a chamber. The container, such a bottle contains liquid, such a hand sanitizer. Then a separate area provides for housing a plurality of dry compressed towels, in the form of tablets. The chamber receives the dry compressed towels and the liquid. A trigger mechanism provides for selectively introducing at least one dry compressed towel and liquid into the chamber. Actuation of the trigger mechanism causes the dry compressed towel to enter the chamber and to be exposed to the liquid so as to be moistened or wetted, thereby being decompressed or expanding. The user can then retrieve the ready to use towel from the chamber.

20 Claims, 11 Drawing Sheets

(51) Int. Cl.
*A47K 7/03* (2006.01)
*A47K 10/32* (2006.01)

(58) Field of Classification Search
USPC ..... 221/96; 118/264, 266, 267
See application file for complete search history.

(56) References Cited

U.S. PATENT DOCUMENTS

| | | | | |
|---|---|---|---|---|
| 4,666,099 | A * | 5/1987 | Hoffman et al. | 242/564.1 |
| 5,265,509 | A * | 11/1993 | Chen | 83/282 |
| 7,018,473 | B2 * | 3/2006 | Shadrach, III | 118/315 |
| 7,318,949 | B2 * | 1/2008 | Shadrach, III | 427/424 |
| 7,850,041 | B2 * | 12/2010 | Amundson et al. | 221/96 |
| 7,856,941 | B2 * | 12/2010 | Nelson et al. | 118/325 |
| 2004/0200410 | A1 * | 10/2004 | Shadrach, III | 118/400 |
| 2006/0151513 | A1 * | 7/2006 | Shadrach, III | 221/1 |
| 2009/0031952 | A1 * | 2/2009 | Lazar | 118/695 |

FOREIGN PATENT DOCUMENTS

| | | | |
|---|---|---|---|
| JP | 2002306362 | A | 10/2002 |
| WO | 2007066865 | A1 | 6/2007 |

* cited by examiner

DISPENSER OF TOWELS WETTED WITH HAND SANITIZER

CROSS REFERENCE TO RELATED APPLICATIONS

The present application claims priority on U.S. Provisional Patent Application Ser. No. 61/367,313 filed on Jul. 23, 2010 and incorporated herein in its entirety.

TECHNICAL FIELD

The present disclosure generally relates to cleaning or sanitation products used for instance to clean hands. More particularly, but not exclusively, the present disclosure relates to dispensers of sanitizing liquids.

BACKGROUND

With increased awareness of germ transmission in all areas of our environment there exists an increased need for a safe and user friendly means to clean exposed personal areas and objects. Attempts have been made to address this concern using pre-moistened cloths. These cloths come in various sizes and thicknesses, and are available in re-useable flexible or hard packaging. Common problems would arise due to the packaging being compromised and the cloths drying out.

Also, the cloth saturation is not uniform throughout the packaging and would tend to have a higher solution concentration on the cloths near the bottom of the container/package as a function of the container/package's orientation over time. In addition, the cloths may become inseparable during extraction from the packaging, whereby the user would get two or more cloths at once. This reduces the amount of useable cloths available in a single packet and thereby cost the consumer more money over time.

Existing products provide limited choices available to the consumer with regard to disinfectant type, color, towel size, towel consistency and size.

In spite of these various devices and products, there remains a need for moist towels or cloths provided with a sanitizer.

OBJECTS

An object of the present disclosure is to provide a novel towel dispensing device.

It is also an object of the present disclosure to provide a novel dispensing device of wetted towels, such as with a sanitizing liquid.

It is a further object of the present disclosure to provide a novel towel dispensing device that is user friendly, and that can typically be operated with a single hand.

It is a further aim of the present disclosure to provide a novel towel dispensing device that is portable and reliable.

SUMMARY

In accordance with an aspect of the disclosure, there is provided a towel dispenser comprising: a container for containing liquid; a separate area for housing a plurality of dry compressed towels; a chamber for receiving dry compressed towels and liquid; and a trigger mechanism providing for selectively introducing at least one dry compressed towel and liquid into the chamber, wherein actuation of the trigger mechanism causes the dry compressed towel to enter the chamber and to be exposed to the liquid so as to be moistened.

In accordance with an aspect of the disclosure, there is provided a kit for dispensing towels comprising: at least one container for containing liquid; a plurality of dry compressed towels; a unit for housing a plurality of dry compressed towels; a chamber for receiving dry compressed towels and liquid; and a trigger mechanism providing for selectively introducing at least one dry compressed towel and liquid into the chamber, wherein actuation of the trigger mechanism causes the dry compressed towel to enter the chamber and to be exposed to the liquid so as to be moistened.

In accordance with an aspect of the disclosure, there is provided a dual hand sanitizer comprising: a container for containing a hand sanitizing liquid and comprising an outlet for releasing hand sanitizing liquid into the ambient environment; a separate area for housing a plurality of dry compressed towels; a chamber for receiving dry compressed towels and liquid; and a trigger mechanism providing for selectively introducing at least one dry compressed towel and liquid into the chamber, wherein actuation of the trigger mechanism causes the dry compact towel to enter the chamber and to be exposed to the liquid so as to be moistened.

In an embodiment, the dry compressed towels are in a tablet form. In an embodiment, the dry compressed towels are vertically stacked within the separate area. In an embodiment, the vertically stacked dry compressed towels are upwardly biased via a spring force. In an embodiment, the moistened towel is caused to decompress.

In an embodiment, the chamber comprises a cover, the cover being movable so as to provide access to the moistened towel. In an embodiment, a trigger element is mounted to the cover. In an embodiment, the chamber is positioned above the separate area. In an embodiment, the chamber is positioned beneath the separate area. In an embodiment, the chamber is positioned adjacent the separate area. In an embodiment, the chamber and the separate area are in communication. In an embodiment, the chamber and the separate area are separated by a wall member providing an open space thereabove, the dry compressed towels being vertically stacked with the uppermost dry compressed towel being adjacent to the open space. In an embodiment, the chamber comprises a towel slot having an enclosure, the slot providing an opening to the separate area, wherein opening of the enclosure provides for introducing a dry compressed towel into the chamber and closing the enclosure provides for isolating the dry compressed towel in the separate area from the chamber.

In an embodiment, the trigger mechanism when actuated pushes the uppermost dry compact towel into the chamber via the open space. In an embodiment, the trigger mechanism comprises a trigger element for pushing the uppermost towel into the chamber. In an embodiment, the trigger element comprises a hook. In an embodiment, the hook is contiguous with a tab for being hand actuated so as to push the uppermost towel into the chamber. In an embodiment, the trigger mechanism comprises a pump to introduce liquid into the chamber. In an embodiment, the pump comprises a tube attached thereto, the tube accessing the container at one end thereof for liquid extraction. In an embodiment, the tube enters the chamber at an opposite end thereof for liquid saturation of the towel in the chamber. In an embodiment, the tube comprises a spray tube for spraying liquid into the chamber. In an embodiment, the pump comprises valves for isolating the flow of liquid. In an embodiment, the trigger mechanism comprises a trigger element for being hand actuated so as to cause introduction of a dry compressed towel into the chamber. In an embodiment, the trigger mechanism comprises a trigger element for being hand actuated so as to cause introduction of liquid into the chamber. In an embodiment, the trigger mechanism comprises a trigger element for being hand actuated so as to cause introduction of liquid into the chamber, the trigger element comprising a trigger arm for actuating the pump. In an embodiment, the trigger element comprises a tab. In an embodiment, the trigger element is returned to its starting position following actuation by spring force. In an embodiment, the trigger mechanism comprises a motion sensor for detecting the motion of a hand and thereby causing a dry compressed towel to enter the chamber to be exposed to liquid. In an embodiment, the dispenser further comprises an enclosure for isolating the dry compressed towels from the chamber, the trigger mechanism being in operational communication with the enclosure and providing for opening the enclosure so as to allow a dry compressed towel to enter the chamber when the motion sensor detects the motion of a hand. In an embodiment, the trigger mechanism comprises a pump in communication with the container and the chamber, the pump providing for pumping liquid from the container into the chamber, the pump being in operational communication with the motion sensor so as to be actuated thereby when the motion sensor detects the motion of a hand. In an embodiment, there is provided a trigger mechanism comprising: components necessary to introduce a dry towel into a chamber for the purpose of being exposed to liquid, being hand actuated by the force of a hand or finger, compressing springs that will, upon release, return the trigger to its starting position. In an embodiment, there is provided a trigger mechanism comprising: a hand or finger actuated tab that will actuate a pump to introduce liquid into the spray chamber for the purpose of saturating a dry towel and will return to its starting position by a spring force. In an embodiment, there is provided trigger mechanism comprising: the combination of functionality as identified herein, whereby the trigger introduces a dry towel into the chamber and also actuate a pump to spray the liquid onto the towel. In an embodiment, there is provided a trigger mechanism comprising: an electrically actuated system whereby the dry towel is introduced into the spray chamber and saturated with liquid. In an embodiment, there is provided both an electrical and manual trigger mechanism for placing a dry towel into the spray chamber and/or actuating the pump to spray the liquid.

In an embodiment, the container comprises a bottle. In an embodiment, the bottle is removable from the dispenser. In an embodiment, the dispenser further comprises a main body defining an opening for removable receiving the bottle therein. In an embodiment, the bottle comprises an outlet. In an embodiment, the outlet is positioned outside the chamber to release liquid into the ambient environment. In an embodiment, the outlet is positioned above the chamber, the outlet being downwardly movable to expel liquid from the bottle into the chamber. In an embodiment, the outlet is positioned inside the chamber to release liquid therein. In an embodiment, the outlet comprises a nozzle. In an embodiment, the bottle comprises a first and a second outlet. In an embodiment, the first outlet is positioned above the second outlet. In an embodiment, the first outlet is positioned above the chamber and the second outlet is positioned within the chamber.

In an embodiment, the dispenser further comprises a movable cover for covering the chamber and the outlet and for providing access thereto when being moved. In an embodiment, the movable cover further covers the separate area and provides access thereto when moved.

In an embodiment, the dispenser further comprises an outlet for releasing liquid from the container into the ambient environment, the trigger mechanism comprising an outlet pump in communication with the container and the outlet, the outlet pump providing for pumping liquid from the container into the ambient environment via the outlet, the pump being in operational communication with the motion sensor so as to be actuated thereby when the motion sensor detects the motion of a hand. In an embodiment, the dispenser is a handheld portable unit. In an embodiment, the dispenser is mountable to a structure. In an embodiment, the dispenser further comprises a window for allowing visual access to the separate area.

In an embodiment, the liquid is an antimicrobial solution.

In an embodiment, there is provided a unit, typically able to be handheld, comprising: a solution in liquid or other form housed in a separate container and a plurality of towels housed in a separate area that, by means of actuation, combine both the liquid and the dry towel.

In an embodiment, there is provided a gated slot that functions to block passage of a dry towel either into the spray chamber, or a wet towel back into the towel slot while providing the ability to seal the spray chamber, and also to open through trigger manipulation to introduce a dry towel into the spray chamber.

In an embodiment, the dry towels are housed in a separate area of the unit, isolated from the liquid, and loaded against a spring force. In an embodiment, there is provided a plurality of dry towels that are housed in separate parallel areas of the unit isolated from the liquid, and loaded against a spring force and can be rotated to the correct position for introduction into the spray chamber.

In an embodiment, there is provided an extraction tube comprising: a non metallic flexible tube attached to a pump and having the opposite end that enters or accesses the bottle for the purpose of liquid extraction. In an embodiment, there is provided a spray tube comprising: a non metallic flexible tube attached to a pump and having the opposite end entering the spray chamber for the purpose of towel saturation.

In an embodiment, there is provided a pump mechanism or a plurality of pump mechanisms comprising: valves that isolate the flow of liquid and are actuated by hand via a trigger mechanism as identified herein.

In an embodiment, there is provided a spray chamber cover comprising: a non-metallic covering of the spray chamber that can be opened to allow access to the spray chamber for the purpose of refilling the unit, maintaining the unit, and extracting the towel.

In an embodiment, there is provided a nozzle attached to the bottle that provides for extraction of the liquid in a foam form. In an embodiment, there is provided a nozzle that comprises: a rotational characteristic that would allow the nozzle to be positioned either inside or outside of the spray chamber.

In an embodiment, there is provided a bottle that is housed in the unit in such a way as to allow it to be squeezed and thereby through the pressure exerted on the bottle can introduce liquid into the chamber for towel saturation In an embodiment, there is provided a towel cartridge that comprises: a separate housing for towel storage, which can be inserted into the unit as identified herein in lieu of loading the unit individually with dry towels.

In an embodiment, there is provided a sliding weight system that comprises: a weighted component that slides on an internal track of the unit identified herein and through the movement of this weight by shaking the unit back and forth actuates a pump mechanism via a cam or similar system which in turn introduces liquid into the chamber.

Other objects, advantages and features of the present disclosure will become more apparent upon reading of the following non-restrictive description of embodiments thereof, given by way of example only with reference to the accompanying drawings

BRIEF DESCRIPTION OF THE DRAWINGS

In the appended drawings, where like reference numerals denote like elements throughout and in where.

DETAILED DESCRIPTION OF ILLUSTRATIVE EMBODIMENTS

Figure 1:
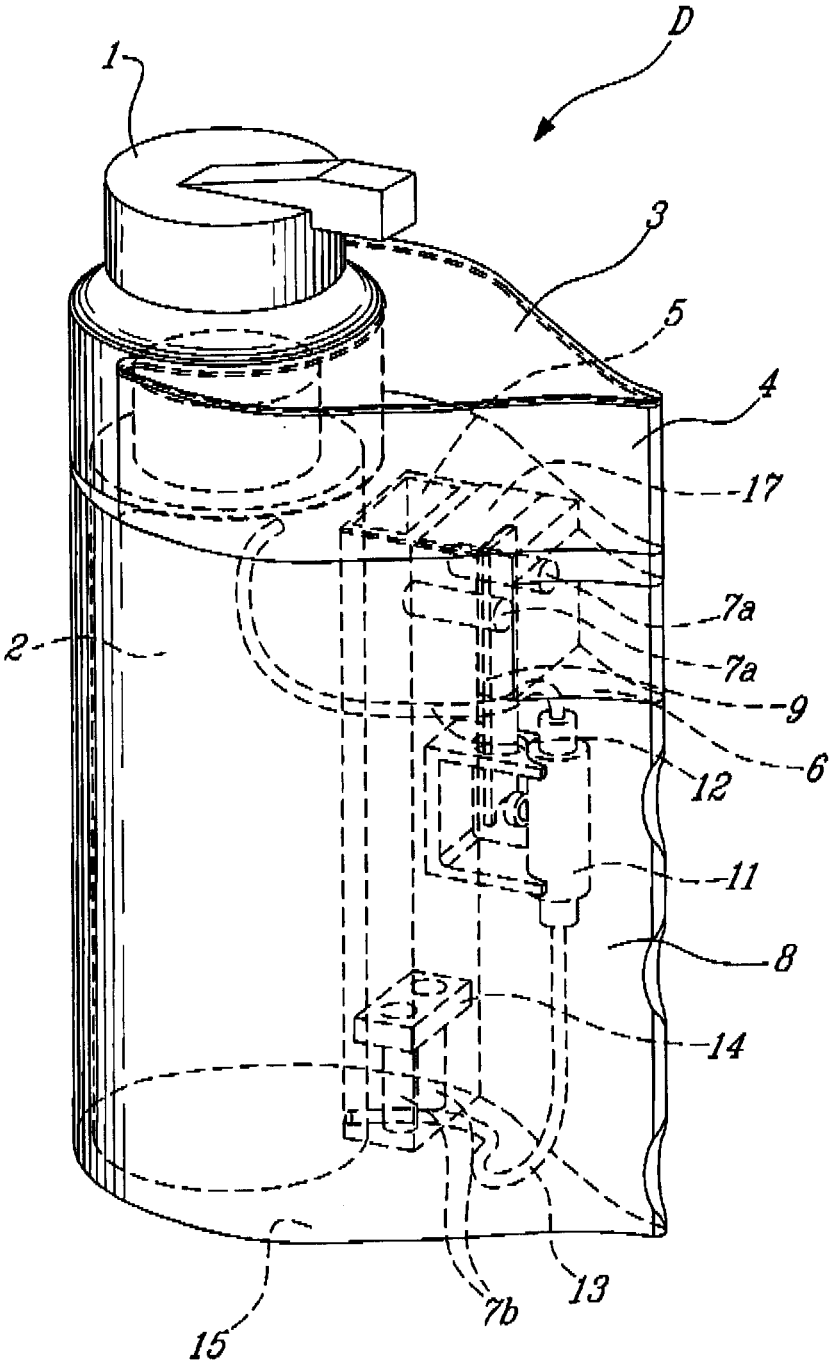
FIG. 1 is an isometric view of a device for dispensing towels wetted with a sanitizing agent in accordance with a first embodiment of the present disclosure, the device being shown in see-through format to illustrate various internal components thereof.
Figure 2:
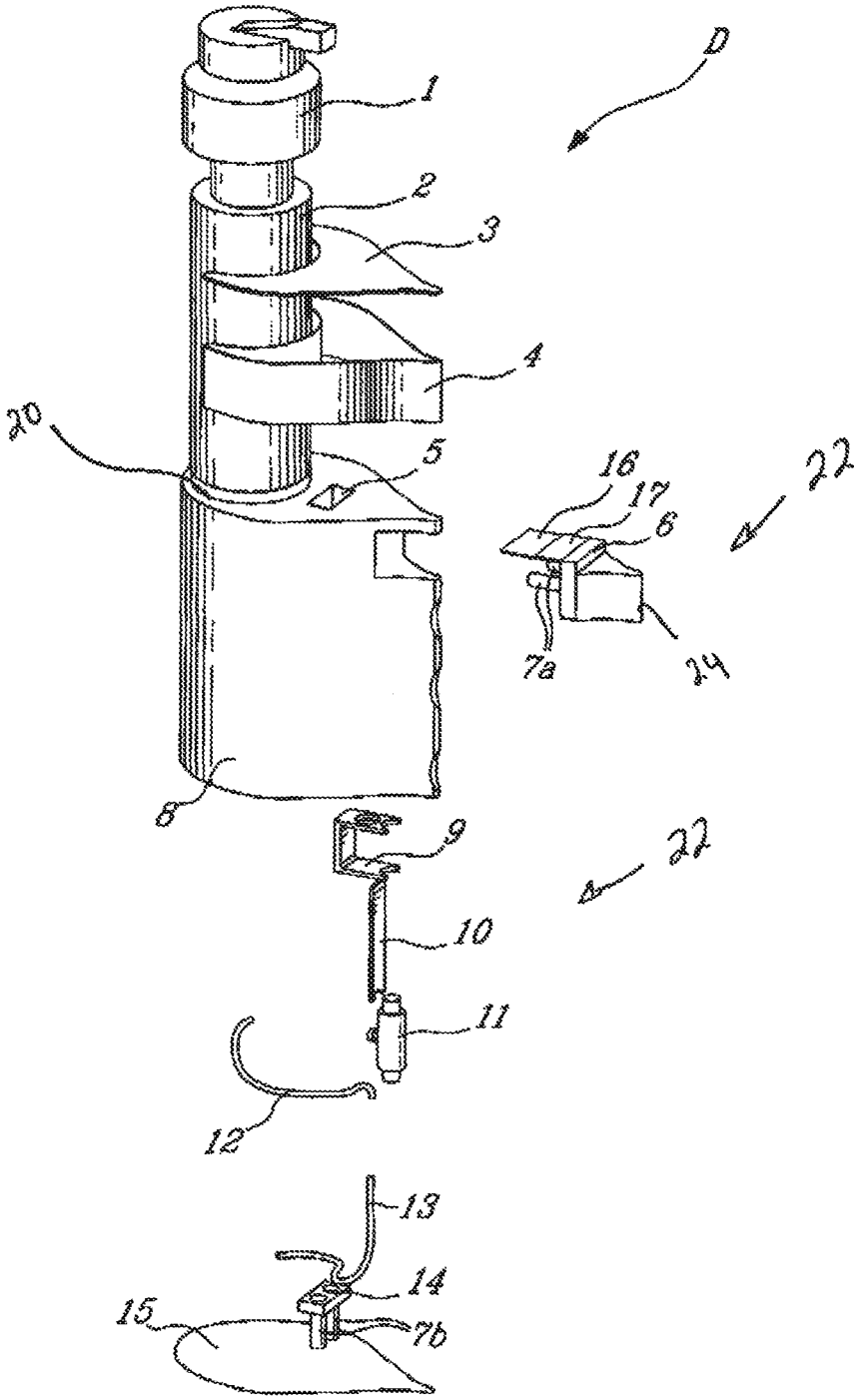
FIG. 2 is an exploded view of the towel dispensing device of FIG. 1.

Generally stated and in accordance with a non-restrictive embodiment of the disclosure, there is provided a towel dispensing device that desires to replace the presoaked towels or separate towels and solution options currently available to consumers. The user can depress the trigger(s) of the towel dispensing device to introduce a dry towel (e.g. in the form of a compressed tablet) into a chamber thereof, and upon releasing the trigger the towel is moistened by a predetermined amount of liquid such as antibacterial solution for example. Extraction of the towel is then made directly from the chamber and used as desired. In an embodiment, the towel dispensing device also includes a nozzle that delivers antibacterial foam solution for further disinfecting as desired. The device can be a handheld portable unit or a stationary mounted unit. The device can be operated with a single hand. The device can be refillable.

Turning to FIGS. 1-4 of the appended drawings, the towel dispensing device of the present disclosure is shown at D. In this non-limiting example, the device D is a handled portable device.

The towel dispensing device D is typically made from nonmetallic materials with the exception of the springs (to be addressed in more details hereinbelow). The towel dispensing device D can be made in various sizes to appeal to use within different environments for example, home, car, and garage. Conveniently, the device D is generally of such a size so as to comfortably fit in the hand and small enough to be portable within a purse, for example.

The towel dispensing device D includes a main body such as cartridge 8. The cartridge 8 provides the housing and anchoring points for other components and is adapted to hold therein a series of dry towels (for instance 10 compressed tablets that will each produce a towel that e.g. has a size of 23×24 cm and is made of 100% cotton), in a stacked relationship (such compressed tablets, also herein referred to generically as towels, can be seen through the clear viewing window of the variant dispensing device illustrated in FIG. 3).

A bottom cover 15 is provided at the lower of the cartridge 8 and is used to close the bottom of the cartridge 8 to facilitate assembly, protect the internal components, and provide access for repair and/or part replacement.

The dispensing device D also includes a container such as a bottle 2 adapted to contain a liquid such as a disinfectant/antibacterial liquid. The bottle 2 is provided with an outlet such as an upper dispensing nozzle 1 that, when pressed downwardly, expels foam directly from the bottle 2. The bottle 2 is able to be installed and removed from the dispensing device D by sliding it in/out of the cartridge 8 which provides an opening 20 for the bottle 2. This provides the means to replace or refill the bottle 2. The nozzle 1 is attached to the bottle 2 either before or after bottle installation in the cartridge 8.

A chamber 4 is provided atop the cartridge 8 and is adapted to receive therein a dry compressed towel from the cartridge 8 and to then be moistened or saturated with antibacterial liquid, as described hereinbelow, a towel slot 5 is defined in the upper wall of the cartridge 8, where the dry towels are stored. A chamber cover 3 closes the chamber 4 and provides a sealed area to contain the liquid while the towel is being saturated.

A spring pad 14 is provided at the bottom of the cartridge 8. When the towels are loaded into the cartridge 8, through the towel slot 5, they are placed on the spring pad 14. Springs **7*b* are provided under the spring pad 14 and are compressed as more towels are loaded. The compressed spring force acts against the spring pad 14 to push the dry towel into the chamber 4**.

The dispenser D also comprises a trigger mechanism in the form of an assembly for selectively introducing dry compressed towels and liquid in the chamber 4.

The trigger mechanism includes a trigger element 6 mounted on the cartridge 8 to provide the means to close/open the towel slot 5, when the trigger 6 is pressed. The trigger element 6 is hand actuated and includes a tab 24 for being pressed. The trigger element 6 also moves another element, namely trigger arm 10 so as to actuate a pump 11. Springs **7*a* are provided behind the trigger element 6. The springs 7*a* provide a force that moves the trigger element 6 to its starting position, and using the spring pad 14, introduce a towel into the chamber 4 through the towel slot 5. The springs 7 move the trigger element 6 back into its original position, when the trigger element 6** is released.

Through movement of the trigger element 6, the trigger arm 10 actuates the pump mechanism 11 to draw liquid from the bottle 2 and spray the liquid into the chamber 4, when the trigger 6 is released. The pump 11 is typically a generic pump that functions to draw liquid from the bottle 2, and introduce it into the chamber 4 using a series of valves. Bracket 9 is fixed to the cartridge 8 and is provided to support the pump 11 in the cartridge 8.

An extraction tube 13 is used to extract liquid from the bottle 2, via operation of the pump 11. A spray tube 12 is provided to direct liquid from the pump 11 into the spray chamber 4.

Means are provided so that the spray chamber cover 3 can be rotated to allow access to the interior of the spray chamber 4. This exposes the towel slot 5. When the trigger 6 is not pressed, the towel slot 5 is in the closed position by means of an enclosure such a flexible tab 16 that is part of the trigger geometry. This flexible tab 16 also has a hole 17 that matches the geometry of the towel slot 5. Pressing the trigger element 6 exposes the spring pad 14 as the hole 17 in the flexible tab 16 and the towel slot 5 align. This allows access to the spring pad 14. The towels are then loaded vertically into the cartridge 8 by pressing them down onto the spring pad 14 and against the force of the springs 7*b*. Once the cartridge 8 has been completely loaded, the trigger 6 is released. The towel dispensing device D is thus loaded.

The bottle 2 is not engaged at this point with the extraction tube 13. The bottle 2 is then fully pressed into a pocket of the cartridge 8. This engages the extraction tube 13 into the bottle 2 via an access point on the base of the bottle 2. The towel dispensing device D is thus loaded and ready for use.

To use the towel dispensing device D, the user simply needs to press the trigger element 6. This aligns the access holes in both the flexible tab 16 of the trigger 6 and the towel slot 5. The flexible trigger tab 16 is allowed to bend and is directed into a space between the towel slot 5 and the bottle pocket. The spring force (via springs 7*b*) acting on the spring pad 14 forces an uppermost towel through the hole 17 and the towel slot 5 and into the spray chamber 4. The chamber cover 3 restricts the towel from further upward movement. The towel thickness typically matches the height of the chamber 4. This will mitigate any jamming that might occur from more than one towel trying to enter the chamber 4.

In parallel to the trigger element 6 being pressed, the trigger arm 10 actuates the pump 11 and draws a predetermined amount of fluid into the body of the pump 11. The pump 11 uses small ball valves, or similar elements, to direct the fluid during extraction and spraying. When the trigger element 6 is released, the force (via springs 7*a*) acting on the trigger element 6 will bring the trigger element 6 back to a starting position thereof. In addition, as the trigger element 6 moves back, the trigger arm 10 actuates the pump 11 and sends the liquid in the pump body through the spray tube 12 and into the chamber 4 where the dry towel is located. The towel is then saturated. The chamber cover 3 can then be opened and the saturated towel removed for use. This process can be repeated until all towels are used, or when the bottle 2 is empty. In addition, the bottle 2 has the nozzle 1 that can be separately actuated to produce antibacterial foam to use as necessary.

Figure 3:
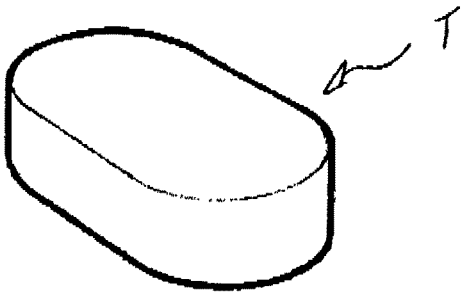
FIG. 3 is a perspective view of a dry compressed towel in accordance with an embodiment of the present disclosure.
Figure 4:
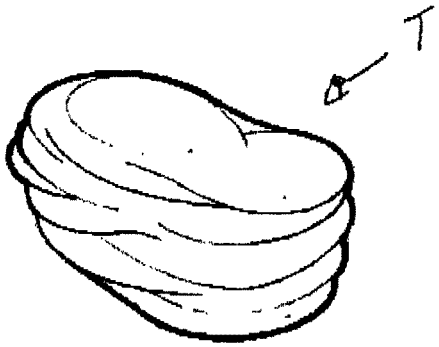
FIG. 4 is a perspective view of the towel of FIG. 3 when moistened in accordance with an embodiment of the present disclosure.
Figure 5:
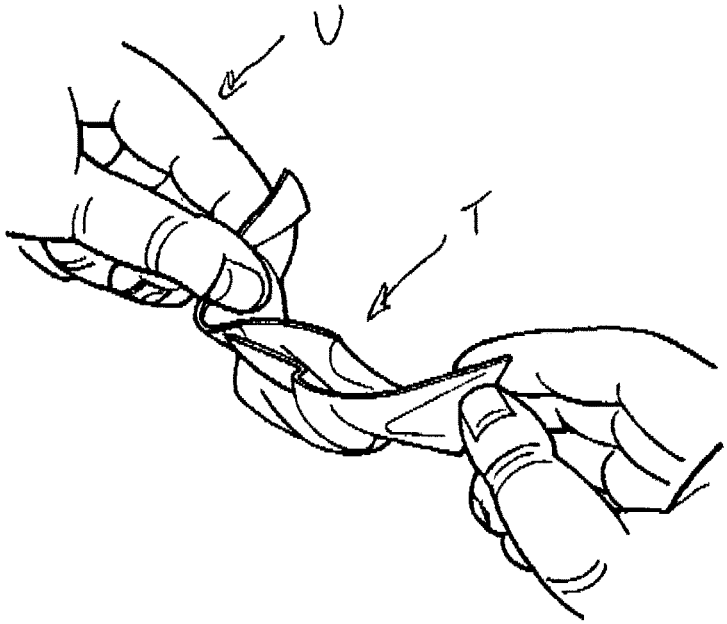
FIG. 5 is a perspective view of the towel of FIG. 3 when moistened and removed from the device for dispensing towels by a user.

FIG. 3 shows a dry compressed towel T in compact tablet form when in the separate area of the dispenser D. FIG. 4 shows the towel T when it is moistened within chamber 4 so as to decompress, expand and begin to unfold from its compact and compressed state to the degree that the space provided by chamber 4 allows. FIG. 5 shows the towel T when it is dispensed from the chamber 4 by the user U to be unfolded and used. In an embodiment, the towel T is a square or rectangular sheet of non-woven fiber that is pressed together in a dry compressed compact form. In an embodiment, the towel T comprises cotton, paper fibers and synthetic fibers. Of course, the towel T can be made from a variety of other suitable materials.

Further in accordance with the present disclosure, there is provided a dual wall mount towel dispensing device, which operates as follows.

The refillable dual wall mount towel dispensing device consists of two refillable cartridges. One will have the compact 100% cotton towels loaded thereinto, whereas the other will have the liquid solution. The cartridge with the tablets is spring loaded. A button or a motion sensor activates the tablet into a dry chamber. Once the tablet is in the chamber, the chamber is filled with the liquid solution, thereby saturating and expanding the towel. Once this has been completed, the user is then be able to reach into the chamber to pull out the wetted towel.

Again, as per the afore-described towel dispensing device D (i.e., the hand held dual dispenser), there is also provided a line feeding the solution either to be dispensed directly onto the users hand or a line feeding the solution into the chamber. Depending before which sensor the user's hand is being waved, either action will take place.

With respect to the tablet getting activated into the dry chamber, again the tablets are be spring loaded and once the user's hand passes in front of the motion sensor, a tablet is activated into the dry chamber. In order for the tablet to get into the dry chamber, a portion of the floor of the dry chamber is either slid open or open like a drawbridge to allow the tablet entry into the chamber. Once the tablet is inside the chamber, the floor closes up to seal in the liquid and make sure that the balance of the tablets do not get wet.

Figure 6:
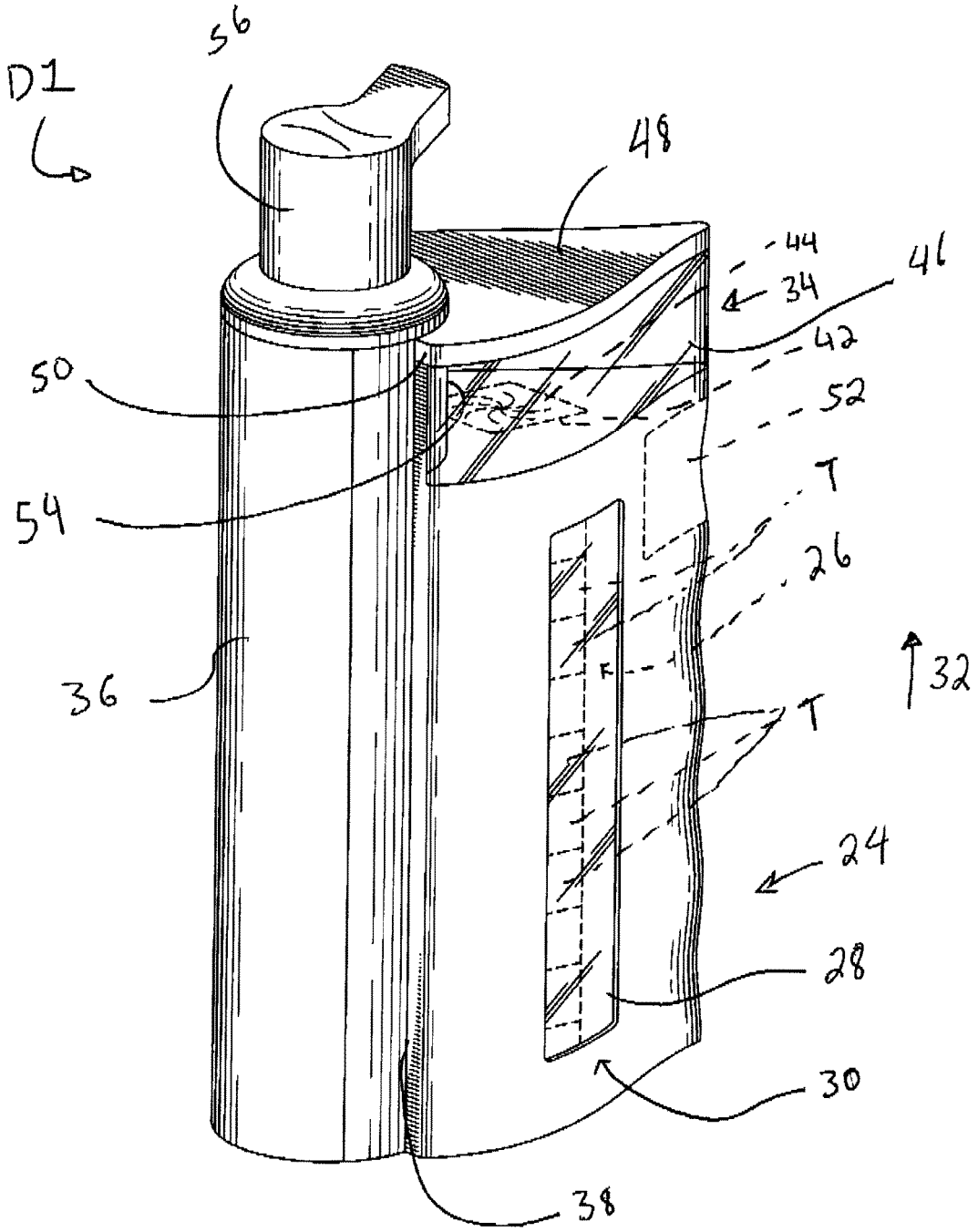
FIG. 6 is a perspective representation of a device for dispensing towels wetted with a sanitizing agent in accordance with a second embodiment of the present disclosure.

FIG. 6 shows an alternate embodiment of a towel dispensing device D1 in accordance with the present disclosure.

The dispenser D1 includes a main body 24 comprising a an internal separate area 26 for receiving dry compressed towels T in a vertical stack. The main body 24 also includes a viewing window 28 so that the towels T can be seen and the remaining number thereof can be ascertained. The separate area 26 is spring loaded at the bottom end 30 thereof so as to upwardly bias the stacked towels T (as shown by arrow 32 towards) towards a chamber 34 which is configured to receive both dry compressed towels and liquid from a container 36. The container 36 is in the form of a bottle and is mounted to the main body 24 via an opening 38 thereof which is in a concave elongate configuration and which includes anchoring elements for removably receiving the bottle 36. In another embodiment, the bottle 36 and the main body 24 are a single integral piece.

The chamber 34 is defined by a floor 40 which includes a slot 42 selectively opened and closed by an enclosure 44 in the form of a swivel valve door that when closed isolates and seals the dry compressed towels T from the chamber 44. Of course, the dry compressed towels in the separate area 26 are also isolated from the liquid in the bottle 36. The chamber 44 includes a peripheral wall structure made of transparent material so as to provide the user to witness the introduction of the towel T within chamber 34 and the moistening thereof. A movable cover 48 covers the chamber 34 and is upwardly movable about a hinged end 50 hingedly connected to the main body 24 for providing the user with access to the moistened towel.

A trigger element 52 provides for actuating the door 44 so as to open slot 52 allowing the spring action at the bottom of the stack of towels T, to push the uppermost towel of the stack through the slot 42 and into the chamber. In tandem the trigger element 52 actuates the bottle to release liquid via an outlet 54 positioned within the chamber 24 for wetting, moistening or saturating the towel T and thereby allowing it to decompress and make it ready for use.

The bottle 36 includes a top outlet 56 or nozzle which provides the users with liquid when downwardly pressed.

Figure 7:
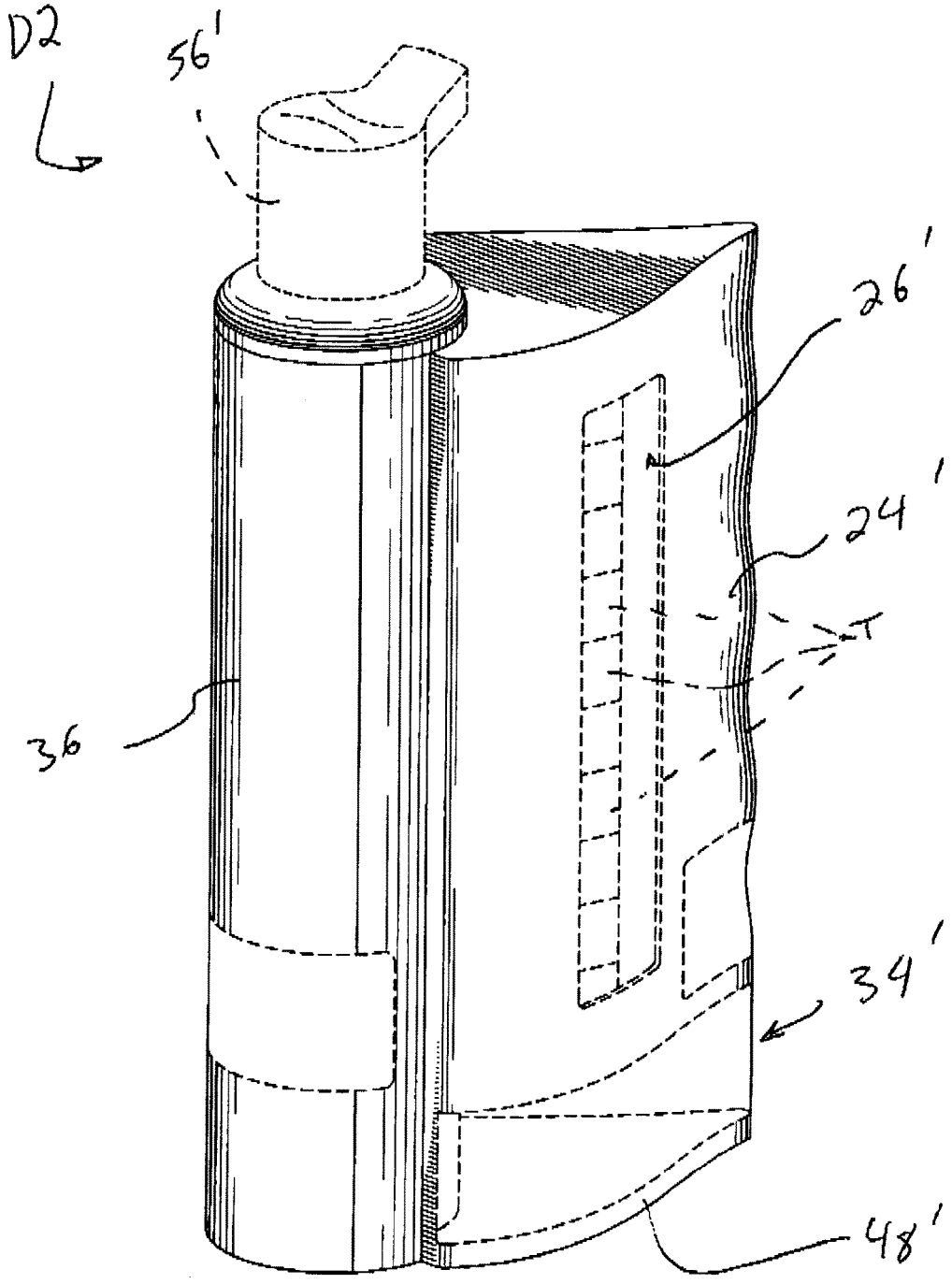
FIG. 7 is a perspective representation of a device for dispensing towels wetted with a sanitizing agent in accordance with a third embodiment of the present disclosure.

Turning now to FIG. 7, there is shown another embodiment of a towel dispensing device D2 in accordance with the present disclosure. Device D2 is similar to device D1 with the exception that the chamber 34' is at the bottom end of the main body 24' positioned beneath the separate area 26' or unit for receiving the dry compressed towels T. In this way, the towels T are dropped by gravity within the chamber 34' A spring can be positioned above the separate area 26' to push the dry compressed towels into the chamber 34'. In order to retrieve the wetted or moistened towels T within the chamber 34' the bottom cover 48' is opened and the ready to use towel T is released.

Figure 8:
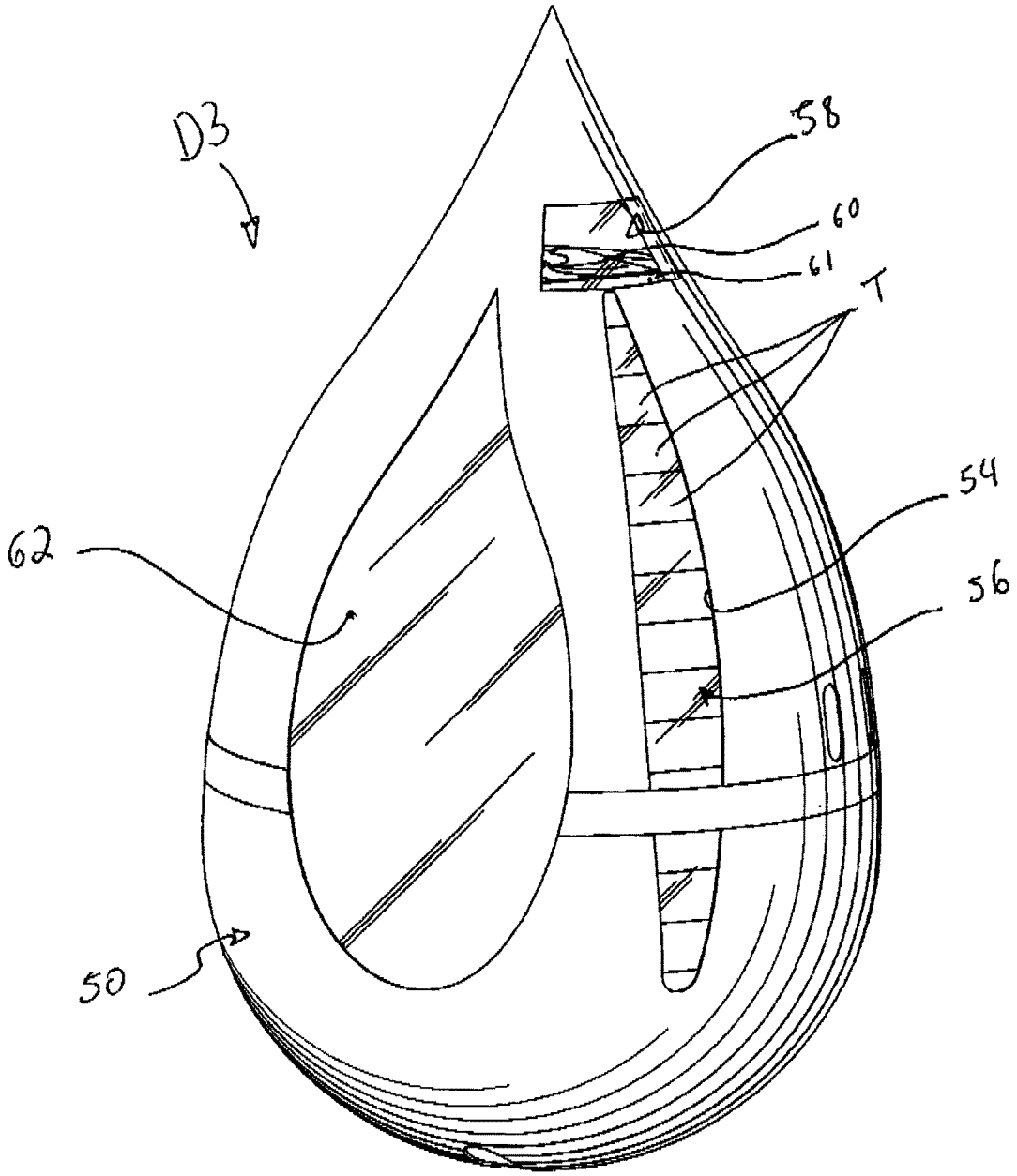
FIG. 8 is a perspective representation of a device for dispensing towels wetted with a sanitizing agent in accordance with a fourth embodiment of the present disclosure.
Figure 9:
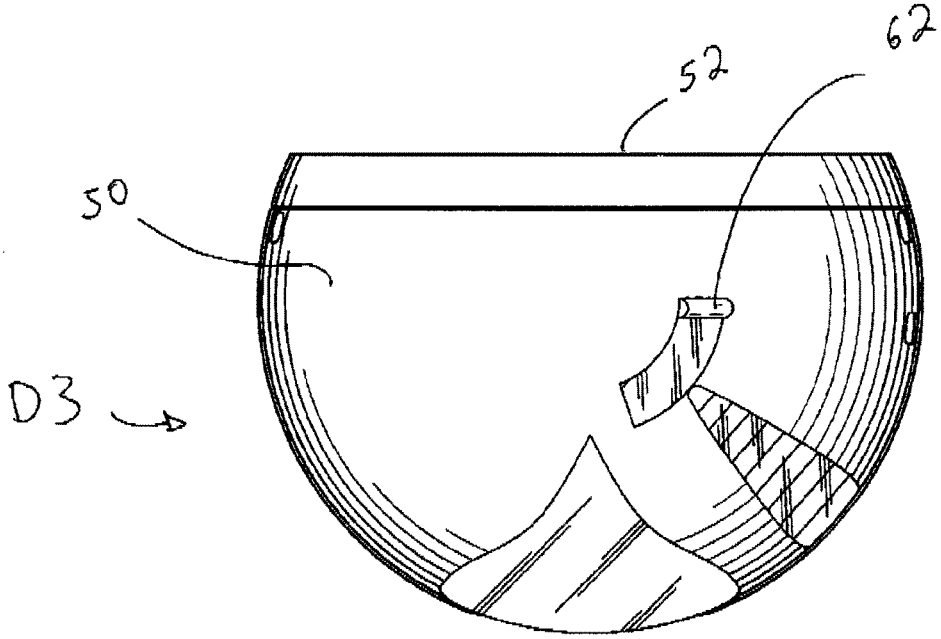
FIG. 9 is a top plan view of the device of FIG. 8.
Figure 10:
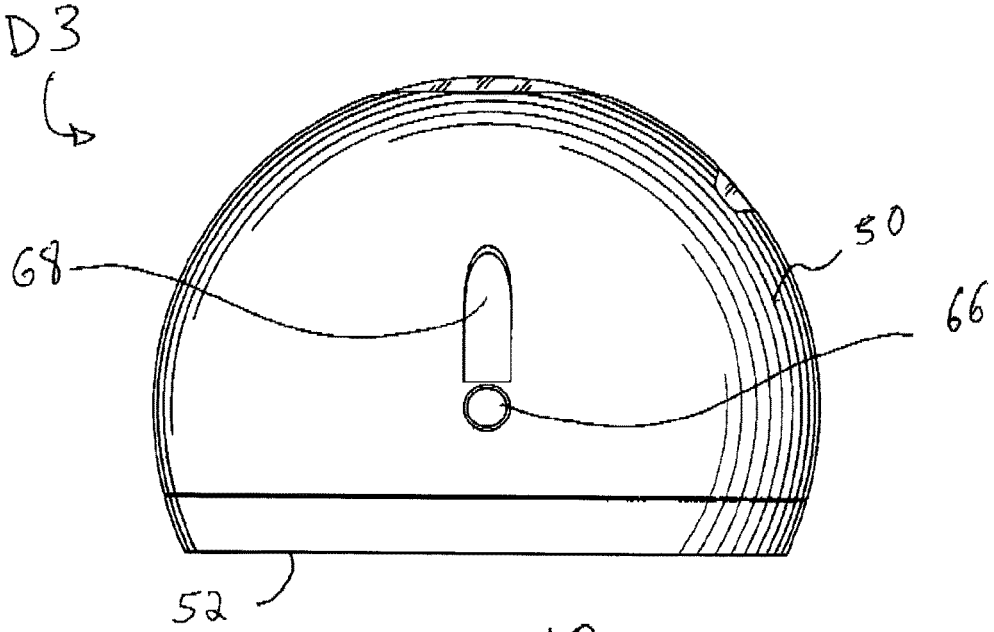
FIG. 10 is a bottom view of the device of FIG. 8.

With respect to FIGS. 8, 9 and 10, there is shown a device D3 for dispensing towels in accordance with a further embodiment.

Device D3 is a wall mounted device having a main body 50 defining a rear side 52 for being mounted to a structure such as a wall. The main body 52 includes a viewing window 54 exposing the dry compressed towel tablets T within a separate area 56 for containing the dry towels and keeping them isolated from any liquids or moisture. The towels T are stacked, upwardly biased by a bottom biasing force (provided by a spring for example) and positioned beneath a chamber 58 that includes an enclosure 60 formed on its floor 61 for being open and closed as previously discussed to introduce a dry towel table T within the chamber 58. The chamber 58 provides for exposing the dry towel tablet T to liquid. The user retrieves the towel after liquid exposure via a sliding transparent door 62.

The main body 50 also includes a container 64 for containing liquid which is released onto the hands of a user via a bottom outlet 66. Liquid is also sprayed into chamber 58 from the container 64 by a pump (not illustrated) via an outlet positioned within the chamber 58 so as to wet or moisten the towel T.

The trigger mechanism of device D3 for actuating the release of liquid via the bottom outlet 66, as well as the introduction of a towel tablet T into the chamber 58 via the opening of enclosure 60 as well as the spraying with liquid of the towel T in the chamber 58 comprises a motion detector for detecting the hands of the user.

Turning now to FIGS. 11, 12, 13 and 14 there is shown a device D4 for dispensing towels T in accordance with yet another embodiment.

The device D4 includes a main body 70 comprising a lateral side with a platform 72 and a ring holder 74 for receiving a container 76 in the form of a bottle with a press nozzle 78 for releasing liquid when pressed. The main body 70 defines a separate internal area or unit 80 for housing a plurality of vertically stacked dry compressed towel tablets T. A chamber 82 is interposed between the bottle 76 and the area 80 thereby being adjacent therewith. A wall 84 separates area 80 and the chamber 82 and provides a top open space thereabove thereby allowing for communication between area 80 and chamber 82.

The dry compressed towel tablets T are stacked on a platform structure 88 that is connected to a spring 89 for being upwardly biased against the top ceiling 91 strip.

The vertical stack of dry towel tablets T is positioned between walls 90 and 92. Wall 90 is in the form of an elongated strip or two or more separate strips. Wall 92 comprises the separator wall 84 which defines the top portion of wall 92 and which is inclined. A portion 94 of wall 90 is correspondingly inclined causing the top portion of the vertical stack of dry towel tablets to be similarly inclined so as to fall on wall portion 94 away from the space 86 above wall 84 which leads to the chamber 82.

A cover 96 is pivotally mounted at the top of the main body 70 so as to cover the separate area 80 and the chamber 84. The cover 96 rests at its free end on the nozzle 78 of the bottle 76.

The cover 96 includes a trigger mechanism defined by a trigger element 98 which is slidably mounted to the cover 96 and includes an external lever or tab 99 for being moved along the length of the cover 96 as shown by arrows 100 and 102.

The trigger element 98 also comprises an internal element 104 protruding from the inner surface of the cover 96 in the form of a flexible hook.

Figure 11:
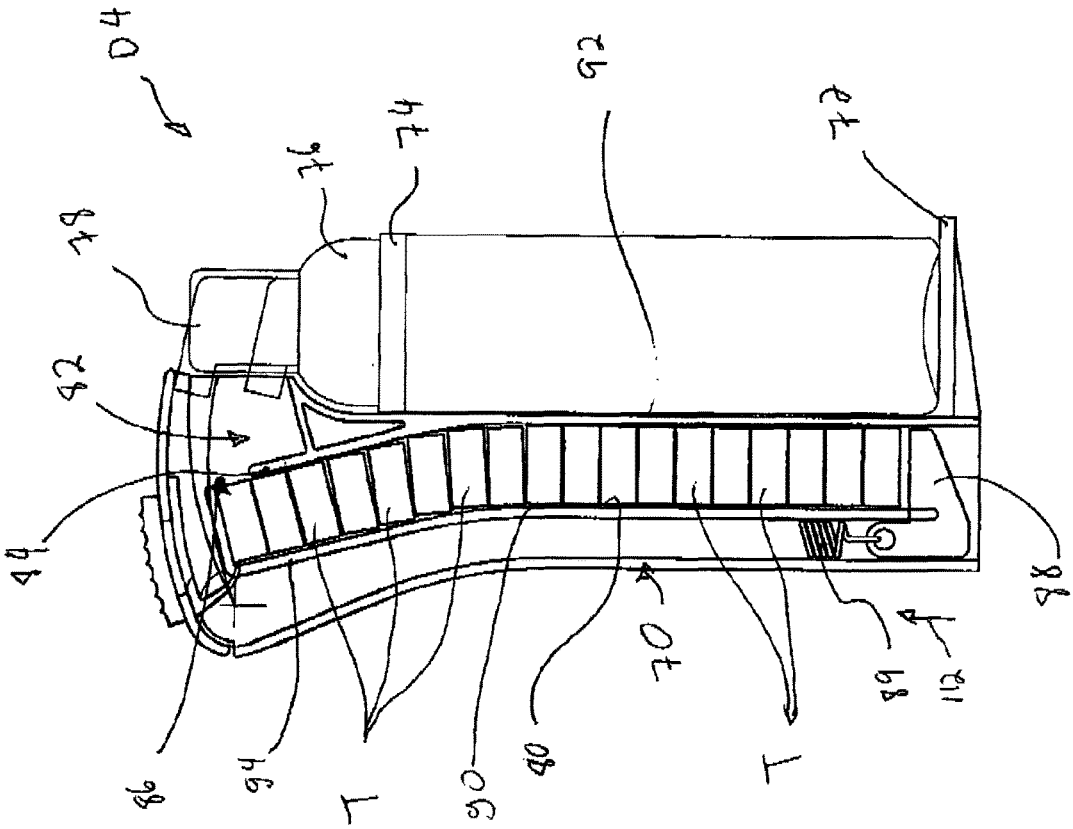
FIGS. 11, 12, 13 and 14 are sequential schematic lateral sectional views of a device for dispensing towels wetted with a sanitizing agent in accordance with a fifth embodiment of the present disclosure, in operation.
Figure 12:
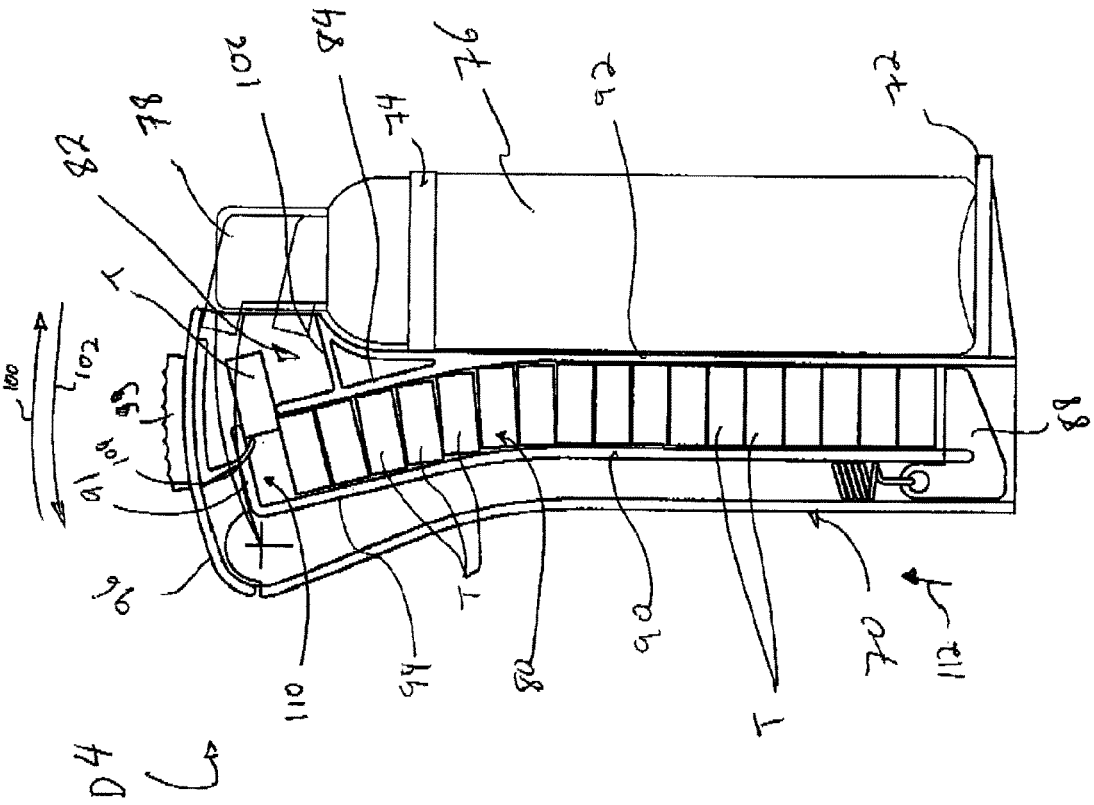
Figure 13:
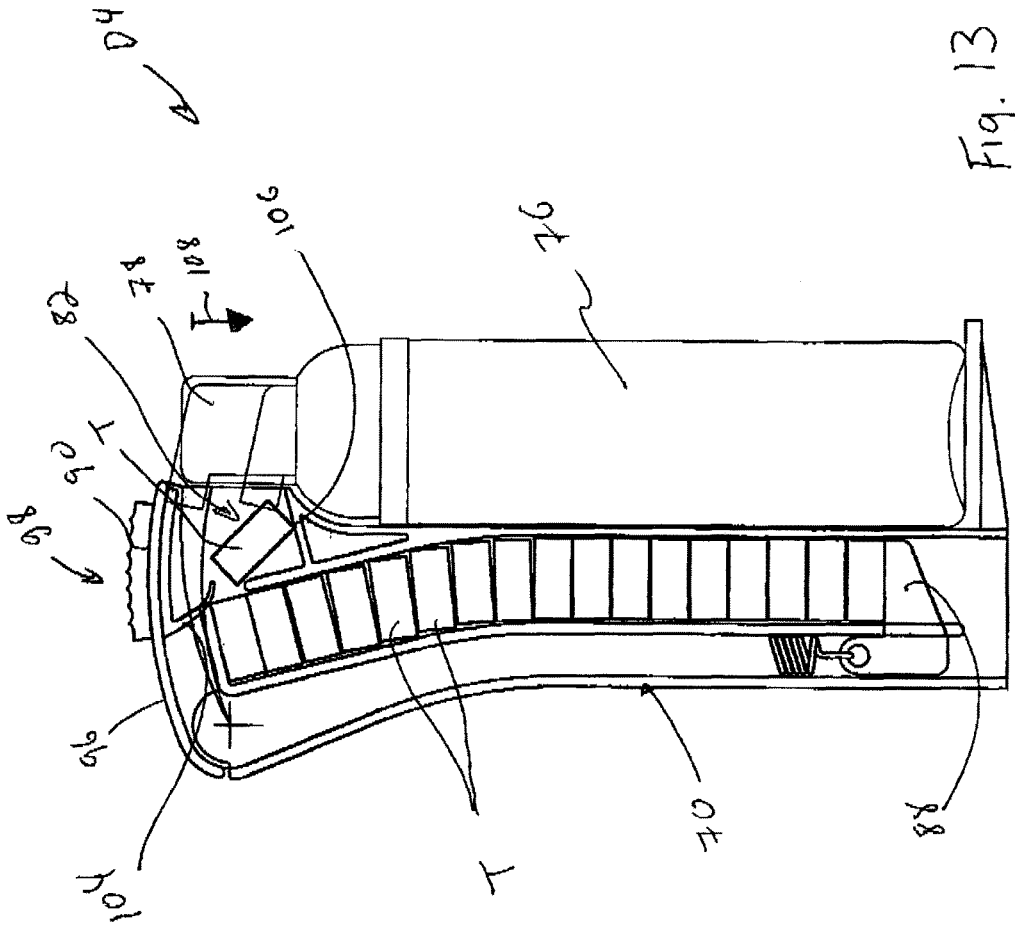

When the user actuates the trigger element 98 by sliding the tab 99 along the cover 96 in the direction shown by arrow 100 as shown in the sequence of FIGS. 11, 12 and 13, the hook 104 engages the uppermost dry compressed towel tablet T of the stack that is sandwiched between the ceiling strip 91 (or strips, as a plurality of separate strips 91 can be provided) and the next lower towel tablet T while resting against wall portion 94 and being adjacent the open space 86. The strip structure of the walls or supports 90 (as well as its portion 94) and 91 which can be provided in a single strip or in a plurality of strips provides a space adjacent wall 90 (as well as portion 94) and wall 91 for the hook 104 to engage the uppermost towel table T thus avoiding any interference between the hook 104 and another portion of the internal components of the main body 70. As the hook 104 engages this uppermost towel tablet it slides it along the surface of the next lower towel table T in the direction shown by arrow 100 through the open space 86 causing it to fall into the chamber 82 and rest on the floor 106 of the chamber 82.

In tandem, as the uppermost towel tablet T is pushed into the chamber 82 it creates a space 110 for the next lower towel table T to take. The platform structure 88 is caused to move upwardly as shown by arrow 112 by the force of spring 89. In an embodiment, the platform structure 88 is guided along the wall strip or strips 90 and as such includes opening to receive the strip guide or guides therethrough so as to slide along the height thereof in the direction shown by arrow 112 moving the stack of towel tablets T upwardly and causing the next lower towel tablet T to take the place of the towel tablet T that was just pushed into the chamber 82.

Figure 14:
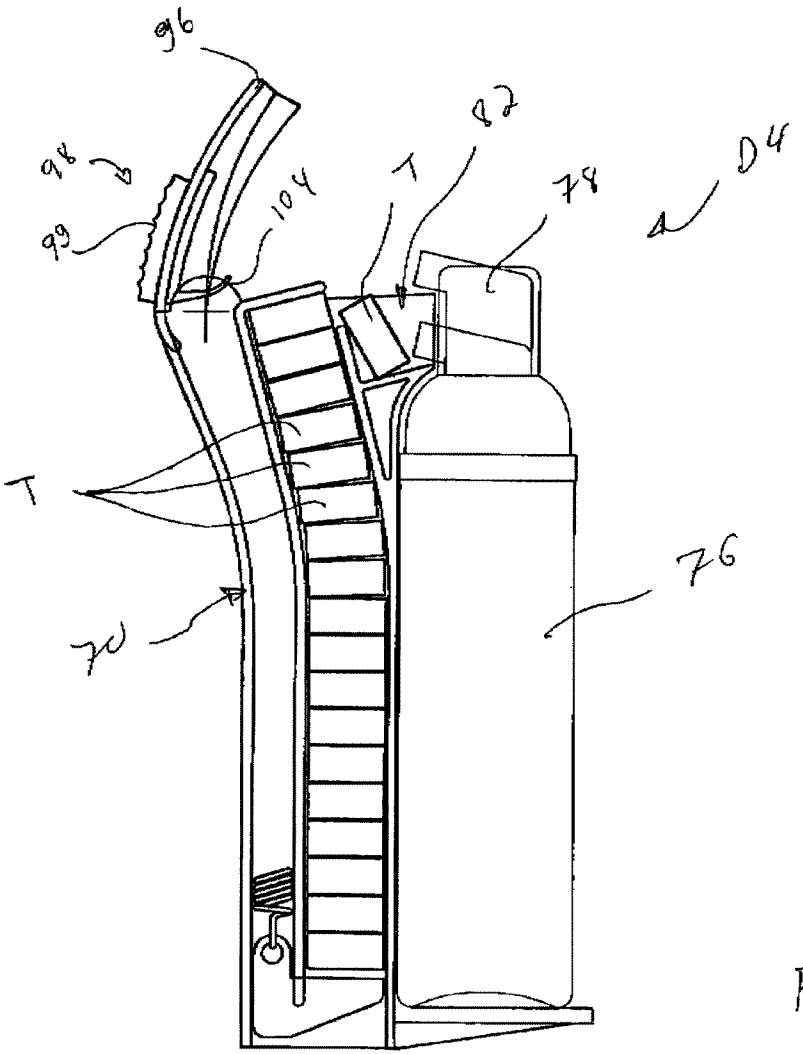

The cover 96 exposes the nozzle 78 which is pushed downwardly as shown by arrow 108 thereby pumping liquid therefrom into chamber 82 and in consequence wetting or moistening the towel tablet T within the chamber 82. The user can then open the cover 96 as is shown in FIG. 14 and retrieve the wetted or moistened towel T within the chamber 82. The user can also retrieve liquid from the bottle 76 for their hands.

It should be noted that the various components and features of the embodiments described above can be combined in a variety of ways so as to provide other non-illustrated embodiments within the scope of the disclosure.

As such, it is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been described hereinabove by way of embodiments thereof, it can be modified, without departing from the spirit, scope and nature of the subject disclosure as defined herein and in the appended claims.

What is claimed is:

1. A towel dispenser comprising:

a container for containing liquid;

a separate area housing a plurality of dry compressed towels arranged in a vertical stack, each of the plurality of dry compressed towels structurally detached from one another;

a chamber for receiving dry compressed towels and liquid, wherein said chamber is positioned adjacent said separate area and separated therefrom by a wall member providing an open space thereabove, an uppermost dry compressed towel of the vertical stack being adjacent to the open space;

a trigger mechanism providing for selectively introducing the uppermost dry compressed towel and liquid into said chamber, wherein actuation of the trigger mechanism causes the uppermost dry compressed towel to enter said chamber and to be exposed to the liquid so as to be moistened; and a spring-loaded pusher causing the vertical stack of structurally detached dry compressed towels in the chamber to be upwardly biased in a direction toward the open space and move upwards at once upon actuation of the trigger mechanism.

2. A towel dispenser according to claim 1, wherein said chamber comprises a cover, said cover being movable so as to provide access to the moistened towel.

3. A towel dispenser according to claim 1, wherein the dry compressed towels are in a tablet form and wherein each tablet is detached from other tablets.

4. A towel dispense according to claim 1, wherein the vertical stack of dry compressed towels are upwardly biased via a spring force applied underneath the vertical stack.

5. A towel dispenser according to claim 1, wherein said trigger mechanism when actuated pushes said uppermost dry compressed towel into said chamber via the open space.

6. A towel dispenser according to claim 5, wherein said trigger mechanism comprises a trigger element for pushing the uppermost dry compressed towel into said chamber.

7. A towel dispenser according to claim 6, wherein said trigger element comprises a hook.

8. A towel dispenser according to claim 7, wherein said hook is contiguous with a tab for being hand actuated so as to push the uppermost towel into said chamber.

9. A towel dispenser according to claim 8, wherein said chamber comprises a cover, said cover being movable so as to provide access to the moistened towel, said tab being mounted to said cover.

10. A towel dispenser according claim 1, wherein said trigger mechanism comprises a pump to introduce liquid into said chamber.

11. A towel dispenser according to claim 1, wherein said trigger mechanism comprises a trigger element for being hand actuated so as to cause introduction of the uppermost dry compressed towel into said chamber.

12. A towel dispenser according to claim 1, wherein said trigger mechanism comprises a motion sensor for detecting the motion of a hand and thereby causing a dry compressed towel to enter the chamber to be exposed to liquid.

13. A towel dispenser according to claim 1, wherein said dispenser is a handheld portable unit.

14. A towel dispenser according to claim 1, wherein said dispenser is mountable to a structure.

15. A towel dispenser according to claim 1, further comprising a window for allowing visual access to said separate area.

16. A towel dispenser according to claim 1, wherein the liquid is an antimicrobial solution.

17. A dual hand sanitizer comprising:

a container for containing a hand sanitizing liquid and comprising an outlet for releasing hand sanitizing liquid into the ambient environment;

a separate area housing a plurality of dry compressed towels arranged in a vertical stack, each of the plurality of dry compressed towels structurally detached from one another;

a chamber for receiving dry compressed towels and liquid, wherein said chamber is positioned adjacent said separate area and separated therefrom by a wall member providing an open space thereabove, the dry compressed towels being vertically stacked with an uppermost dry compressed towel being adjacent to the open space;

a trigger mechanism providing for selectively introducing at least one dry compressed towel of the vertical stack and liquid into said chamber, wherein actuation of the trigger mechanism causes the at least one dry compressed towel to enter said chamber and to be exposed to the liquid so as to be moistened; and a spring-loaded pusher causing the vertical stack of structurally detached dry compressed towels in the chamber to be upwardly biased in a direction toward the open space and move upwards at once actuation of the trigger mechanism.

18. A towel dispenser comprising:

a container for containing liquid;

a separate area housing a plurality of dry compressed towels arranged in a vertical stack, each of the plurality of dry compressed towels structurally detached from one another;

a chamber for receiving dry compressed towels and liquid, wherein said chamber comprises a towel slot having a closing means, said slot providing an opening to said separate area;

a trigger mechanism providing for selectively introducing at least one dry compressed towel of the vertical stack and liquid into the chamber, wherein actuation of the trigger mechanism causes opening of said closing means for introducing a dry compressed towel into said chamber to be exposed to the liquid so as to be moistened and closing said closing means provides for isolating the dry compressed towel in said separate area from said chamber; and a spring-loaded pusher causing the vertical stack of structurally detached dry compressed towels in the chamber to be upwardly biased in a direction toward the open space and move upwards at once upon actuation of the trigger mechanism.

19. A towel dispenser according to claim 18, wherein said trigger mechanism comprises a trigger element for being hand actuated so as to cause introduction of liquid into said chamber.

20. A towel dispenser according to claim 18, wherein said container comprises a bottle.

* * * * *